US006240703B1

(12) United States Patent
Brown

(10) Patent No.: US 6,240,703 B1
(45) Date of Patent: Jun. 5, 2001

(54) INSULATED CLOSURE STRUCTURE AND METHOD

(75) Inventor: Noel S. Brown, Jacksonville Beach, FL (US)

(73) Assignee: CNB Enterprises, Inc., Jacksonville, FL (US)

( * ) Notice: Subject to any disclaimer, the term of this patent is extended or adjusted under 35 U.S.C. 154(b) by 0 days.

(21) Appl. No.: 09/274,673

(22) Filed: Mar. 24, 1999

(51) Int. Cl.[7] ..... E04C 2/54; A47F 3/00

(52) U.S. Cl. ..... 52/784.15; 52/212; 52/794.1; 49/489.1; 49/504; 49/70; 312/138.1

(58) Field of Search ..... 52/211, 212, 784.15, 52/794.1; 49/70, 400, 501, 504, 384, 470, 489.1, 490.1, 165, 498, 495; 312/138, 401, 405, 406, 236, 138.1

(56) References Cited

U.S. PATENT DOCUMENTS

| | | | | |
|---|---|---|---|---|
| 3,673,735 | | 7/1972 | Winsler et al. . | |
| 3,757,473 | | 9/1973 | Mundy . | |
| 4,006,562 | | 2/1977 | Belanger et al. . | |
| 4,180,944 | | 1/1980 | Stowik et al. . | |
| 4,831,780 | | 5/1989 | Bockwinkel . | |
| 4,940,297 | * | 7/1990 | Borgen | 312/138.1 |
| 4,941,289 | | 7/1990 | Rolek . | |
| 5,111,618 | * | 5/1992 | Kaspar et al. | 49/501 |
| 5,275,029 | * | 1/1994 | Myers | 70/128 |
| 5,351,442 | * | 10/1994 | Gingras | 49/411 |
| 5,645,330 | * | 7/1997 | Artwohl et al. | 312/116 |
| 5,704,107 | * | 1/1998 | Schmidt et al. | 29/460 |
| 6,036,292 | * | 3/2000 | Mandel et al. | 312/405 |

* cited by examiner

*Primary Examiner*—Carl D. Friedman
*Assistant Examiner*—Yvonne M. Horton
(74) *Attorney, Agent, or Firm*—Allen, Dyer, Doppelt, Milbrath & Gilchrist, P.A.

(57) ABSTRACT

An enclosure door for an insulated space includes an insulated door member that is hingedly mountable to a door frame of an insulated enclosure. A release latch is attached to the door frame for opening the door member. Further, a protective member is affixed in covering relation to at least a portion of an inner face of the door member and is operable to open the door member upon experiencing an impact thereupon. In a particular embodiment, the protective member is affixed to each of a pair of facing door members, each operable to open both door members upon experiencing an impact thereupon.

14 Claims, 3 Drawing Sheets

INSULATED CLOSURE STRUCTURE AND METHOD

BACKGROUND OF THE INVENTION

1. Field of the Invention

The present invention relates to enclosures and, more particularly, to insulated closure structures for walk-in enclosures such as refrigerators and freezers.

2. Description of Related Art

Walk-in freezer or refrigerator units are large, enclosed spaces used for the storage of perishable items. In many situations, pallet jacks or other means of transporting pallets of stored goods are used to put in or remove the goods from the freezer or refrigerator units. In these situations, it is necessary to have a threshold flush with the inner and outer floors. The standard doors built into the freezer or refrigerator units are too small to allow easy maneuvering of the pallet jacks, with the result that the doors and frames are easily damaged and often require replacement. Typical replacement closures known in the art are units that are affixed externally to the outer wall. These units protrude into the workspace, are weak in respect to thermal barrier properties, and are easily damaged.

The replacement enclosures must perform the same functions as the original closures. They must maintain the temperature differential between the inside of the freezer or refrigerator unit and the outside. The closure should not allow moisture condensation to form on the exterior. The threshold of the closure must remain free of ice to prevent hazardous footing conditions. The replacement closure must be sufficiently insulated and sealed at all points to prevent thermal leakage into the walls or around the door.

In use currently known closure structures are frequently damaged by impact from pallet jacks when operated carelessly inside the enclosure. As enclosure doors are typically made of a pair of spaced-apart, fairly thin metal sheets having a foamlike insulating material disposed between the sheets, an object such as a lifting device hitting the door can cause serious damage and require expensive repairs or complete replacement.

SUMMARY OF THE INVENTION

It is therefore an object of the present invention to provide a replacement closure that has means for being protected from impact damage.

It is an additional object to provide such a closure that includes means for opening the closure door.

It is a further object to provide such a closure wherein an impact upon the protection means causes the door to open.

It is another object to provide such a closure that has a pair of doors.

It is yet an additional object to provide such a closure wherein an impact upon the protection means causes both of the doors to open.

It is yet a further object to provide such a closure having opening means operable upon one of the doors.

It is yet another object to provide a method for providing means for exiting an insulated space.

An additional object is to provide a method for protecting an insulated closure against impact damage.

A further object is to provide a method for making a closure for an insulated space.

These objects and others are attained by the present invention, an enclosure door for an insulated space that comprises an insulated door member that is hingedly mountable to a door frame of an insulated enclosure. Release means are attached to the door frame for opening the door member. Further, protective means are affixed in covering relation to at least a portion of an inner face of the door member and are operable to open the door member upon experiencing an impact thereupon.

In a particular embodiment, the protective means are affixed to each of a pair of facing door members, each operable to open both door members upon experiencing an impact thereupon.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
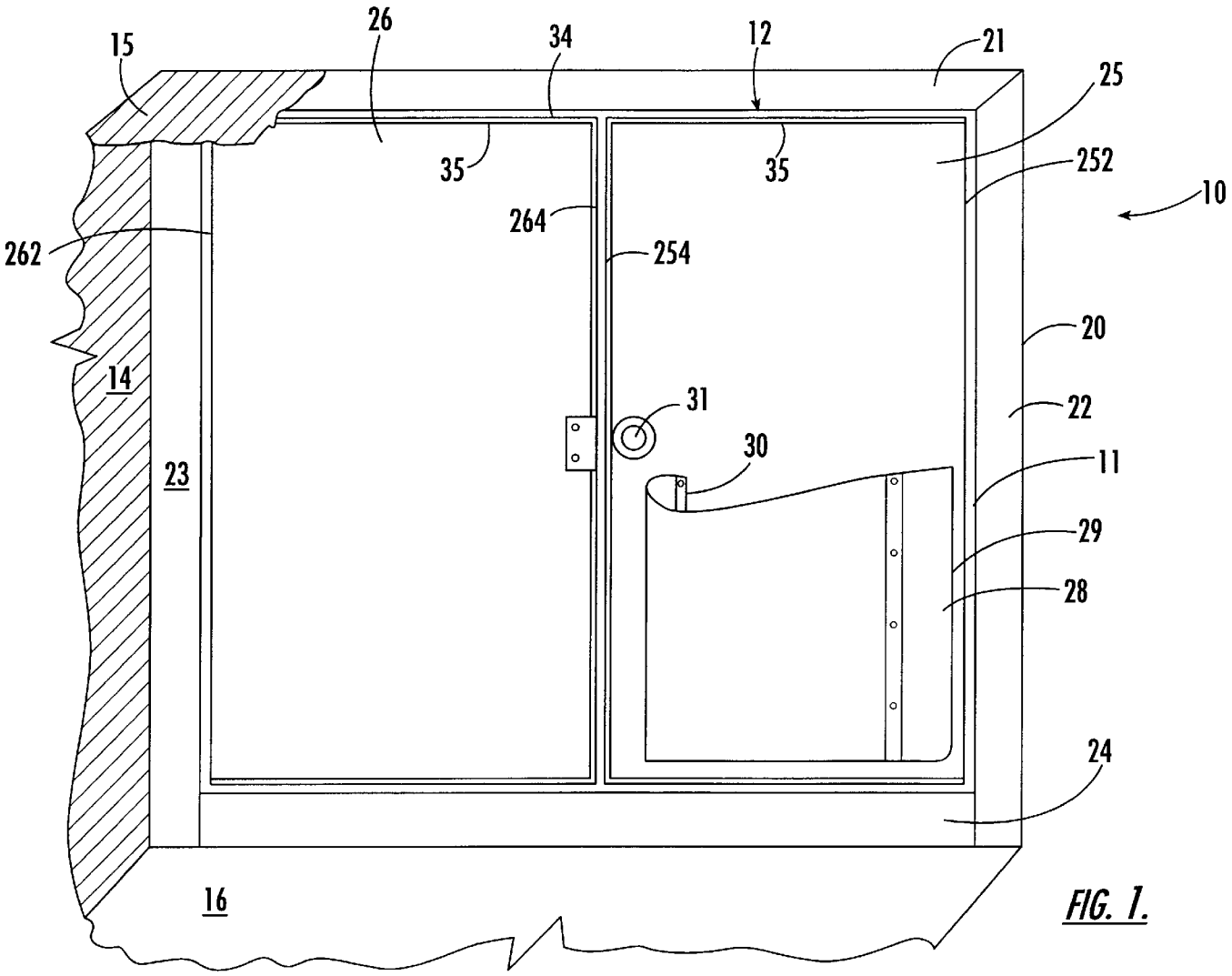
FIG. 1 is an inside view of a part of the enclosure including the closure door of the present invention.
Figure 2:
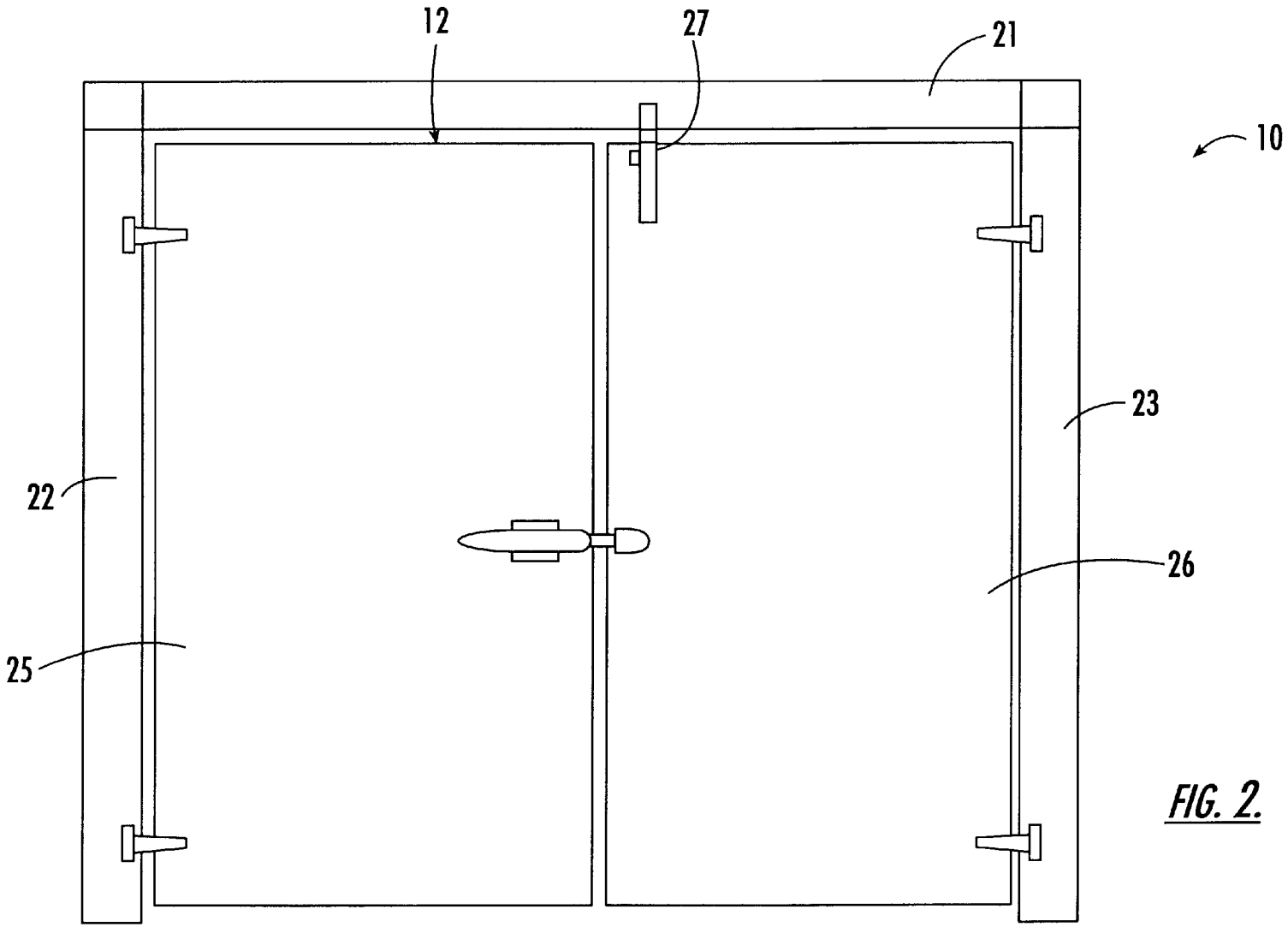
FIG. 2 is an outside view of the enclosure.
Figure 3:
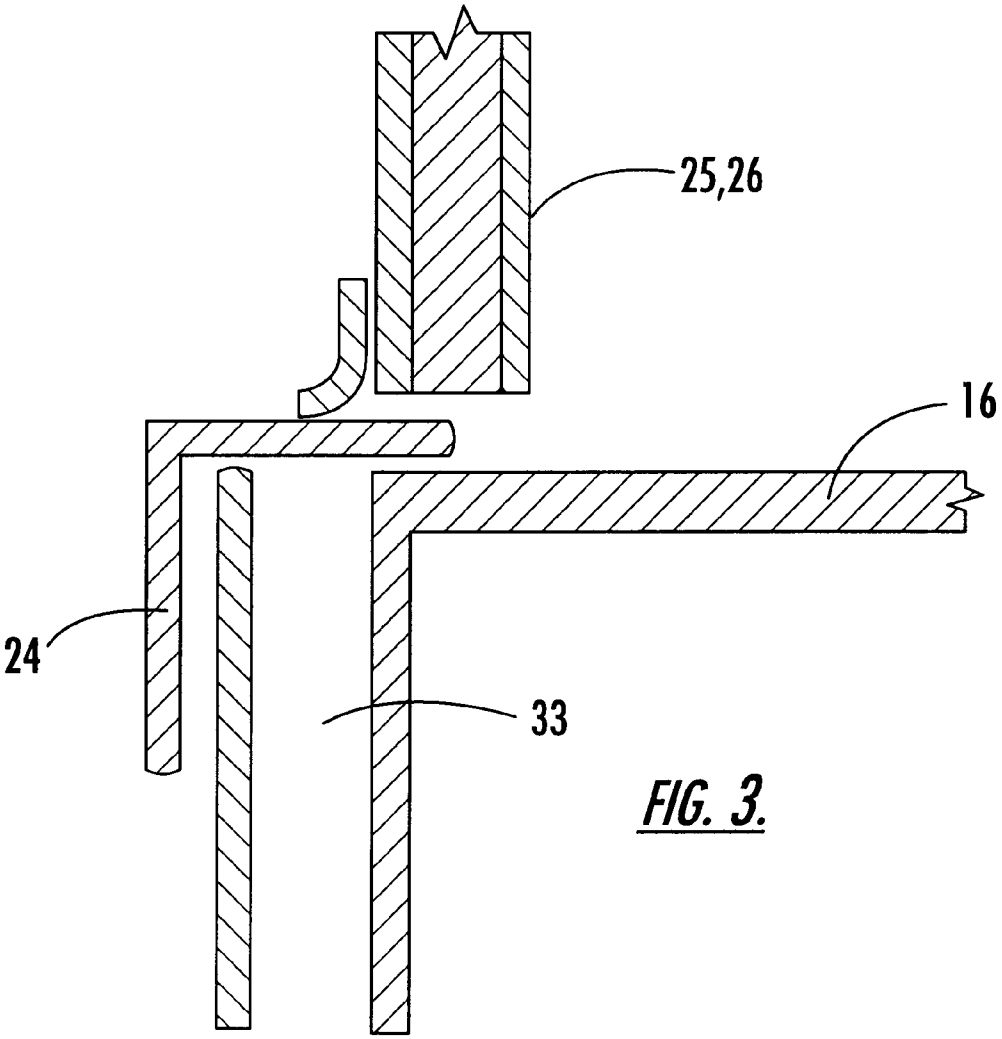
FIG. 3 is a horizontal cross-sectional view of the closure door through 3–3' of FIG. 1.

A description of the preferred embodiments of the present invention will now be presented with reference to FIGS. 1–3.

The various embodiments of the present invention are contemplated for use in temperature-controlled enclosures such as the type of large refrigerators or freezers typically found in supermarkets, especially those that are large enough to drive lifting devices into. As stated above, the doors to such enclosures are frequently subject to damage by lifting devices, since the door shells are relatively thin and are easily damaged by impact. It is therefore desirable to have such doors be replaceable and also resistant to impact damage.

In a particular embodiment illustrated in FIGS. 1–3, the temperature-controllable enclosure 10 includes a door structure 12 that is dimensioned to sealingly fit within a front opening 11 of the enclosure 10, which also has a front 13, sides 14, a top 15, and a floor 16. In some applications a back (not shown) is solid; in others the back also has a door that typically leads to a loading dock outside the store for receiving products from trucks. Thus a lifting device can enter the enclosure 10 from either door to deposit or remove items.

The door structure 12 comprises a frame 20 that has a top member 21 and two side members 22,23 affixed at their top ends to opposed side ends of the top member 21. The frame 20 is affixable within a front opening 11 of the enclosure 10.

The door structure 12 further comprises a threshold member 24 that is affixable at opposed side ends to bottom ends of the side members 22,23. Preferably the threshold member 24 is affixable atop a vapor break 33 between the floor 16 of the enclosure 10 and the floor exterior of the enclosure 10.

An insulated door member is hingedly mountable to a frame side member, and the door member includes means for sealing against the threshold member 24 when in a closed position, such as with flexible gaskets as are known in the art. In a preferred embodiment the door member comprises a first 25 and a second 26 door member, with each door member 25,26 hingedly mountable to a respective opposite side member 22,23 of the door frame 20. Each door member 25,26 typically includes a pair of opposed shells, comprising, for example, metal or fiberglass, although these materials are not intended to be limiting. A foam insulating material is sprayed at high pressure between the shells to prevent bubbling of the foam.

Release means, such as a latch 27 affixed to the outside of the top member 21, are attached to the frame 20 for opening the doors 25,26.

One way of opening one of the doors 25 from the inside is provided by an opening mechanism such as a pushknob 31 as is known in the art, which is operable upon the release latch 27 and prevents a worker from being accidentally locked inside the enclosure 10. The pushknob 31 is positioned on the inner face of the door 25 adjacent the second side 254.

In order to prevent frost from building up in a freezer between the doors 25,26 and between the doors 25,26 and the frame 20, a metal, typically stainless steel, strip 34 having a heating element 35 running therebeneath is affixed about the doors 25,26. The heating element 35 is preferably running essentially constantly to prevent the doors 25,26 from freezing together. Such a heating strip is not required in coolers.

Protective means are affixed in covering relation to at least a portion of an inner face of at least one of the door members, and preferably both the first door member 25 and the second door member 26. Such a protective means may take the form, for example, of a resilient bumper 28 made of a polymeric sheet, in a particular embodiment a 3/16" sheet of polyethylene, affixed to a lower portion of each of the door members 25,26. This positioning permits protection against impact of a motorized lifting device. Each sheet 28 has a first edge 29 affixed adjacent the door members' outer, hinged sides 252,262. A second edge 30 that is opposed to the first edge 29 is affixed to the door members 25,26 adjacent the second sides 254,264, with the second edge 30 curled under an adjacent portion of the sheet 28. An impact upon either of the sheets 28 is operable to effect an opening of both doors 25,26. This opening is distinct from that achieved by the release latch 27 and pushknob 31.

It may be appreciated by one skilled in the art that additional embodiments may be contemplated, including similar enclosures for temperature-controlled environments.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. An enclosure door for an insulated space comprising:

a first and a second door member, each door member hingedly mountable to an opposite side of a door frame of an insulated enclosure;

release means attached to the door frame for opening the door member; and protective means affixed in covering relation to at least a portion of an inner face of the first door member and operable upon the first door member to effect an opening of the first and the second door member upon experiencing an impact thereupon.

2. The enclosure door recited in claim 1, further comprising an opening means positioned upon the door member and distinct from the protective means operable upon the release means to effect a door member opening.

3. The enclosure door recited in claim 1, further comprising an opening means positioned upon the first door member and distinct from the protective means operable upon the release means to effect an opening of the first door member.

4. The enclosure door recited in claim 1, wherein the protective means comprises a first and a second protective means, one protective means affixed in covering relation to at least a portion of an inner face of each of the first and the second door member, respecively.

5. The enclosure door recited in claim 4, wherein the protective means are each operable upon the respective door member to effect an opening of both the first and the second door members upon experiencing an impact thereupon.

6. The enclosure door recited in claim 1, wherein the protective means comprises a resilient bumper affixed along a lower portion of the door member.

7. The enclosure door recited in claim 6, wherein:

the door member is hinged along a first side and has a second side opposed to the first side; and the resilient bumper comprises a sheet of polymeric material having a first edge affixed adjacent the door member first side and a second edge opposed to the first edge affixed to the door member adjacent the second side, the second edge curled under an adjacent portion of the sheet.

8. An insulated door structure for a refrigeratable enclosure comprising:

a frame comprising a top member and two side members affixed at top ends to opposed side ends of the top member, the frame affixable within a front opening of a refrigeratable enclosure;

a threshold member positioned in abutting relation at opposed side ends to bottom ends of the side members;

a first and a second insulated door member, each door member hingedly mountable to an opposite side of a frame side member, the door member including means for sealing against the threshold member when in a closed position;

release means attached to the frame for opening the door member; and protective means affixed in covering relation to at least a portion of an inner face of the first door member and operable to effect an opening of the first and the second door member upon experiencing an impact thereupon.

9. The door structure recited in claim 8, further comprising an opening means positioned upon the first door member and distinct from the protective means operable upon the release means to effect an opening of the first door member.

10. The door structure recited in claim 8, wherein the protective means comprises a resilient bumper affixed along a lower portion of the door member.

11. The door structure recited in claim 8, wherein:

the door member is hinged along a first side and has a second side opposed to the first side; and the resilient bumper comprises a sheet of polymeric material having a first edge affixed adjacent the door member first side and a second edge opposed to the first edge affixed to the door member adjacent the second side, the second edge curled under an adjacent portion of the sheet.

12. The door structure recited in claim 8, wherein the threshold member is affixable atop a vapor break between a floor of the enclosure and a floor exterior to the enclosure.

13. The door structure recited in claim 8, wherein the release means comprises a latch affixed to top member.

14. A method of protecting a pair of generally opposed door members comprising the step of affixing a protective member in covering relation to at least a portion of an inner face of each of the door members, the portion chosen for being subject to impact, wherein the protective members are each operable to effect an opening of both door members upon experiencing an impact upon either or both of the door members.

* * * * *